United States Patent [19]

Ahrendt

[11] Patent Number: 4,523,488

[45] Date of Patent: Jun. 18, 1985

[54] SINGLE LEVER CONTROL DEVICE FOR MULTIPLE FUNCTIONS

[75] Inventor: Donald A. Ahrendt, Chicago Heights, Ill.

[73] Assignee: Allis-Chalmers Corp., Milwaukee, Wis.

[21] Appl. No.: 439,363

[22] Filed: Nov. 5, 1982

[51] Int. Cl.[3] ..... G05G 9/00; E03B 7/07

[52] U.S. Cl. ..... 74/471 XY; 137/636.2

[58] Field of Search ..... 74/471 XY, 471 R, 491; 137/636.2

[56] References Cited

U.S. PATENT DOCUMENTS

| | | | |
|---|---|---|---|
| 3,101,624 | 8/1963 | Hagen et al. | 74/471 XY |
| 3,741,031 | 6/1973 | Schwerdtfeger | 74/471 XY |
| 3,768,328 | 10/1973 | Campbell | 74/471 XY |
| 3,811,336 | 5/1974 | Pulskamp | 74/471 XY |
| 3,831,633 | 8/1974 | Comer | 74/471 XY X |
| 3,943,791 | 3/1976 | Casey | 74/471 XY |
| 4,019,401 | 4/1977 | Drone | 74/471 XY |
| 4,027,547 | 6/1977 | Rahman et al. | 74/471 XY |
| 4,028,958 | 6/1977 | Schuermann et al. | 74/471 XY |

*Primary Examiner*—Allan D. Herrmann
*Assistant Examiner*—Stephen B. Andrews
*Attorney, Agent, or Firm*—Charles L. Schwab

[57] ABSTRACT

A compact single lever control device (26) is provided for a lift truck (11) which permits an operator to operate a carriage raising and lowering control valve spool (77) by lateral movement of a manual control lever (46) and to cause the lift truck to travel in forward and reverse directions by forward and reverse movement of the control lever (46).

4 Claims, 7 Drawing Figures

SINGLE LEVER CONTROL DEVICE FOR MULTIPLE FUNCTIONS

BACKGROUND OF THE INVENTION

1. Technical Field

This invention relates to a single lever control device for effecting multiple functions such as forward/reverse speed and carriage lift/lower functions in a lift truck.

2. Prior Art

The use of single lever control devices for multiple functions is well known. For instance, U.S. Pat. No. 3,741,031 shows a single lever control device wherein a control lever extends through a radial opening in and is pivotally connected to an apertured busing 36. The control lever includes an arm extending through an axial opening in the bushing which connects to a first control member. The bushing is mounted on two widely spaced bearings. Rotation of the bushing about its axis causes a first control to be activated and swinging movement of the control lever relative to the bushing causes a second control to be actuated. U.S. Pat. No. 4,019,401 shows a manual control lever for a plurality of operating functions which is supported by a ball and socket joint with a stabilizer link supporting and stabilizing movement of the control lever. U.S. Pat. No. 4,027,547 shows a single lever control for multiple functions wherein the control lever is supported for universal movement. U.S. Pat. No. 3,811,336 shows a lift truck controller operable to control raising and lowering of the pay load, tilting of the mast, forward and reverse travel and speed.

OBJECTS AND DESCRIPTION OF THE INVENTION

It is an object of the present invention to provide a multiple function control which is very compact so as to fit in the limited space available in a standup rider lift truck.

It is a further object of the present invention to provide an improved single lever control for a lift truck wherein the lift truck operator can control lifting and lowering of the carriage, travel speed and direction with a single manually operated lever.

It is a further object of the present invention to provide a single lever control for a lift truck which is reliable in operation, easy to service and relatively inexpensive in cost.

The single lever control device of this invention includes an upstanding support wall having laterally opposite sides, wall means defining a bearing receiving opening and bearing means mounted in the bearing receiving opening. The bearing means includes a bearing member within the opening rotatable only about a bearing axis transverse to the wall and having wall means defining a central opening through which the bearing axis passes. A control lever is provided which has an upstanding hand grip portion and a horizontal leg extending into the central opening where pivot means pivotally connect the leg to the bearing member for relative pivotal movement only about a pivot axis transverse to the bearing axis. A first control is pivotally connected to the bearing member at a first point spaced from the bearing axis and a second control is pivotally connected to the leg of the control lever at a second point spaced from the pivot axis. Pivoting of the lever about the bearing axis causes actuation of the first control and pivoting of the lever about the pivot axis causes actuation of the second control.

BRIEF DESCRIPTION OF THE DRAWINGS

A preferred embodiment of the invention is illustrated in the drawings in which.

DETAILED DESCRIPTION OF THE PREFERRED EMBODIMENT

Figure 1:
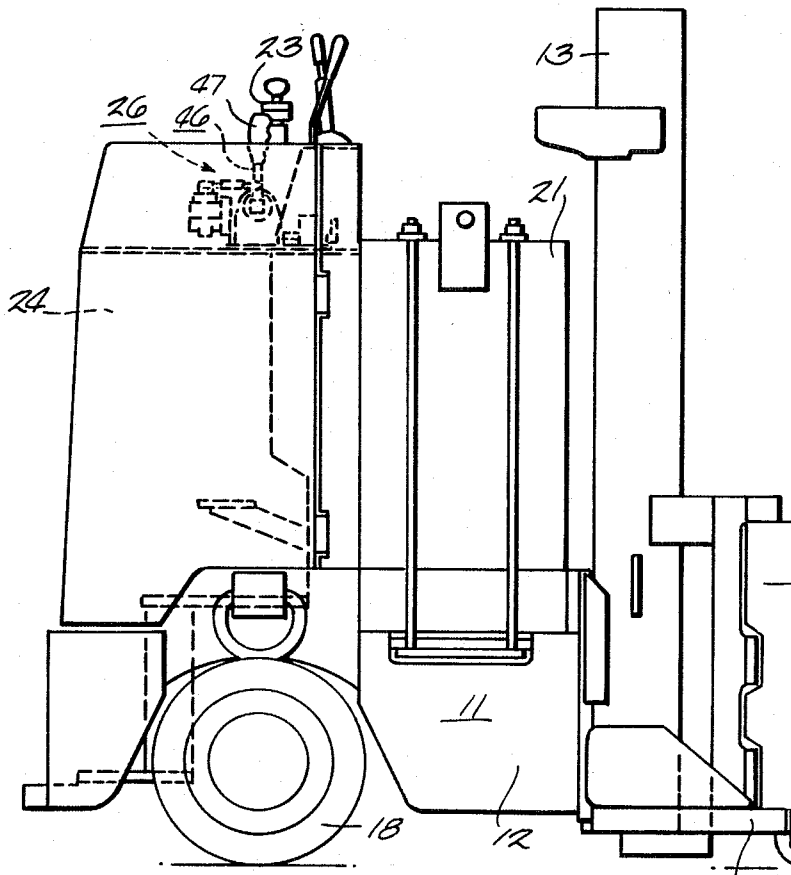
FIG. 1 is a side view of a standup rider lift truck incorporating the invention.
Figure 2:
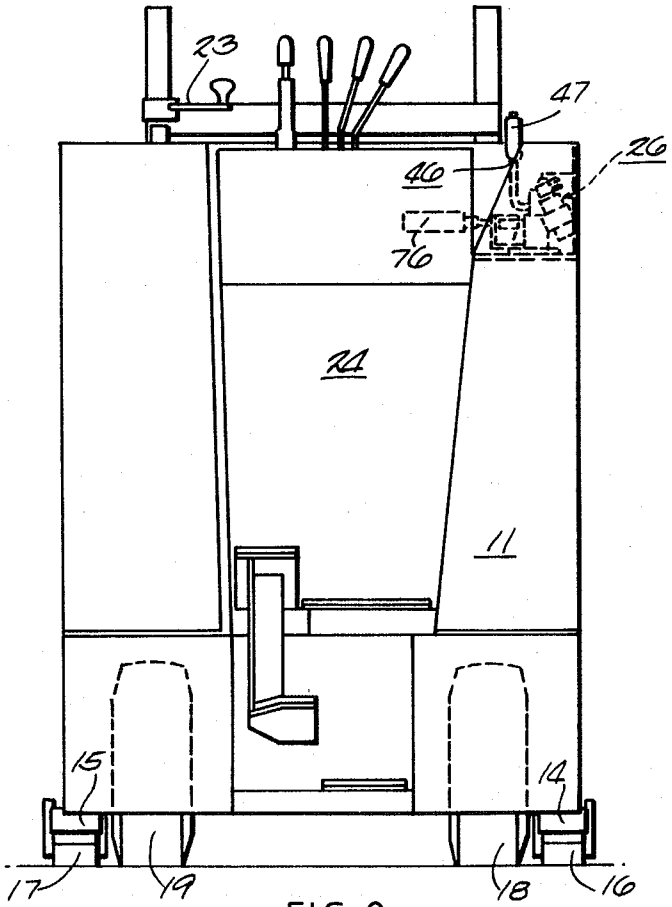
FIG. 2 is a rear view of the lift truck illustrated in FIG. 1.
Figure 4:
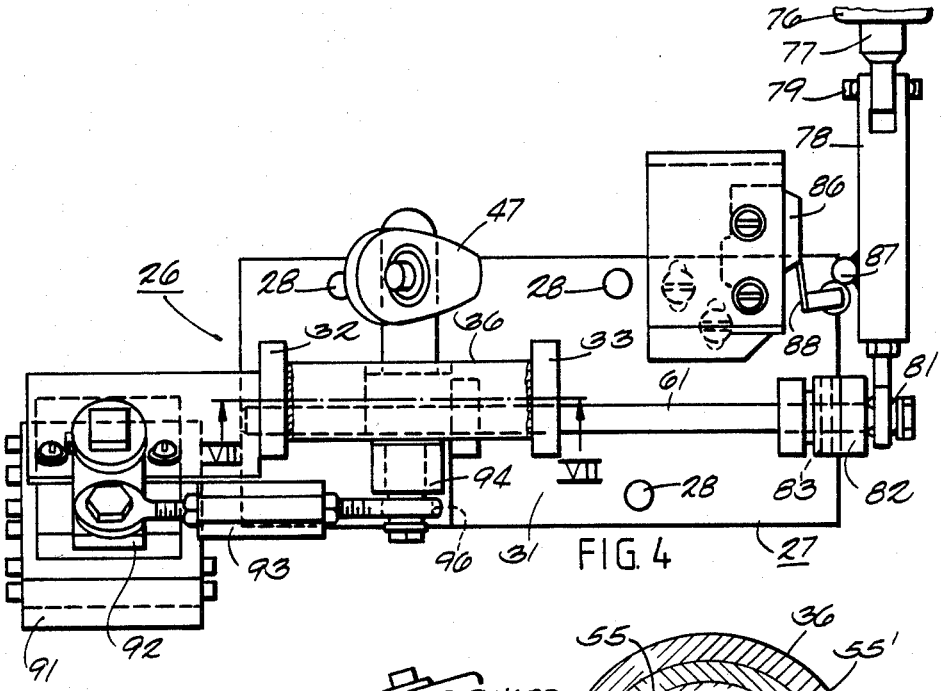
FIG. 4 is a top view of the control device illustrated in FIG. 3.

Referring to FIGS. 1 and 2, a standup rider lift truck 11 includes a main frame 12 on which a lift mast 13 is secured. The pay load is carried by a pair of forks 10 mounted on a carriage 20 which is raised and lowered on the mast 13 by a single acting hydraulic jack, not shown. A pair of straddle legs 14, 15 of the frame 12 are supported at their front ends by small wheels 16, 17 and the rear of the frame 12 is supported by a pair of steerable wheels 18, 19. At least one of the rear wheels is driven by an electric motor, not shown, to which power is supplied by an electric battery 21. A steering lever 23 is provided adjacent the left hand side of the operator station 24.

The single lever control device 26 of the present invention is located at the right hand side of the operator's compartment 24. Referring also to FIGS. 3 through 7, the support 27 for the single lever control 26 is fastened to the main frame 12 of the truck by screws 28. The support 27 includes a flat bottom plate 31 to which a pair of upstanding flanges or walls 32, 33 are welded. An upstanding wall or bearing block 36 is secured, as by welding, to the upper ends of the longitudinally spaced and parallel vertical walls 32, 33 with the lower end 37 of the bearing block being spaced vertically above the bottom plate 31. The upstanding wall or bearing block 36 includes a bore 38 into which a bushing 40 is press fit. The bushing constitutes wall means presenting a radially inner facing cylindrical bearing surface or bearing receiving opening 39 extending to laterally opposite sides of the wall 36. Bearing means are provided within the bearing receiving opening 39 and include a bearing or control member 42 with a radially outward facing annular surface in radial thrust transmitting relation with the bearing surface 39 on the bearing block 36. The bearing member 42 is secured against axial movement relative to the bushing 40 by a retainer in the form of a snap ring 45 disposed in an annular circumferential groove in the bearing member and in axially confronting relation to one axial end of the bushing 40. The bearing member 42 rotates relative to the wall 36 only about a bearing axis 43 and includes a main part disposed within the opening 38 in the wall and presenting wall means defining an axial opening 44. A manually operable lever 46 includes an upstanding hand grip portion 47 and a horizontal leg 48 extending into the opening 44 where an intermediate portion of the leg 48 is pivotally connected to the bearing member 42 on a pivot axis 51 transverse to bearing axis 43 by pivot means 52 disposed within the opening 44. The pivot means 52, as shown in FIG. 7, includes a cylindrical pivot member or pin in the form of a sleeve 53 on a pivot axis 51 mounted in a bore 54 in the lever 46 by a pair of axially aligned stepped diameter bushings 55, 55'. The sleeve 53 fits in a bore 56' in the leg 48 of the lever 46 and is secured against rotation by a set screw 57'. The bore 54 is actually two bores formed on the pivot axis 51 and extending radially in relation to the bearing axis 43 from the central opening 44 in the control member 42 to the radially outward facing cylindrical bearing surface of the control member 42. The stepped diameter bushings 55, 55' have inner bores in radial bearing engagement with portions of the pivot pin 53 extending outwardly from the intermediate portion of the leg 48 and have radially outward facing cylindrical bearing surfaces in bearing engagement with the aligned bore segments constituting bore 54. The radially outward extending flanges of the stepped diameter bushings 55, 55' are in axial bearing engagement with opposite sides of the central opening 44 and the central portion of the leg 48 of the control lever 46.

The pivot axis 51 is disposed between the opposite sides of the wall 36, intersects bearing axis 43 and lies adjacent the central vertical plane 56 of the annular bearing member 42. The leg 48 of the lever 46 extends through the opening 44 a short distance terminating in a free end in the form of a spherical bearing component 57 which is pivotally connected to a control link 58 of a lift/lower control.

The lift/lower control includes a rock shaft 61 having an arm 62 secured thereto by a pin 65. The outer end of the arm 62 is pivotally connected to the control link 58 at a point 63 vertically below the point 64 of connection between the link 58 and the free end 57 of the leg 48 of the control lever 46. The rock shaft 61 is journaled in the wall 32 by bushing 66, passes through an opening 67 in the wall 33 and is supported by a bushing 69 in a bracket 68 welded to the plate 31. The rock shaft 61 is disposed directly below the bearing block 36 with the arm 62 connected thereto in the opening 71 defined by the lower end 37 of the block 36, the upper side of the plate 31 and the confronting sides of the bearing block support walls 32, 33. This arrangement provides a laterally compact control device of the limited space available at the right side of the operator's compartment 24.

A hydraulic control valve 76 of the lift/lower control is mounted on the lift truck at the front of the operator's compartment 24 and includes a valve spool 77 having one end pivotally connected to one end of a control link 78 by a pin 79. The other end of the link 78 is pivotally connected by a ball pivot joint 81 to an arm 82 secured to the rock shaft 61 by a pin 83. The hydraulic control system for raising and lowering the carriage 20, includes a hydraulic pump, not shown, driven by an electric motor, not shown, which is energized to drive the pump only when the valve spool 77 is moved to the right as viewed in FIG. 3. This is achieved through actuating a switch 86 in the pump control circuit by a cam element 87 on the link 78 causing a roller carrying arm 88 of the switch 86 to move to the left as viewed in FIGS. 4 and 5 when the valve spool 77 and link 78 are moved to the right, as viewed in FIG. 3, by clockwise rotation of the control lever 46.

Forward and reverse travel and truck speed are achieved by an electric drive motor control including a pivotable electric control 91 having a pivot arm 92, the free end of which is pivotally connected to one end of a control element in the form of a link 93. The other end of the control link 93 is pivotally connected to the free end of an upstanding arm 94 integral with and extending from one lateral side of the bearing member 42 by a spherical bearing 96 which is spaced above the axis 43 of the bearing member 42.

OPERATION

Figure 6:
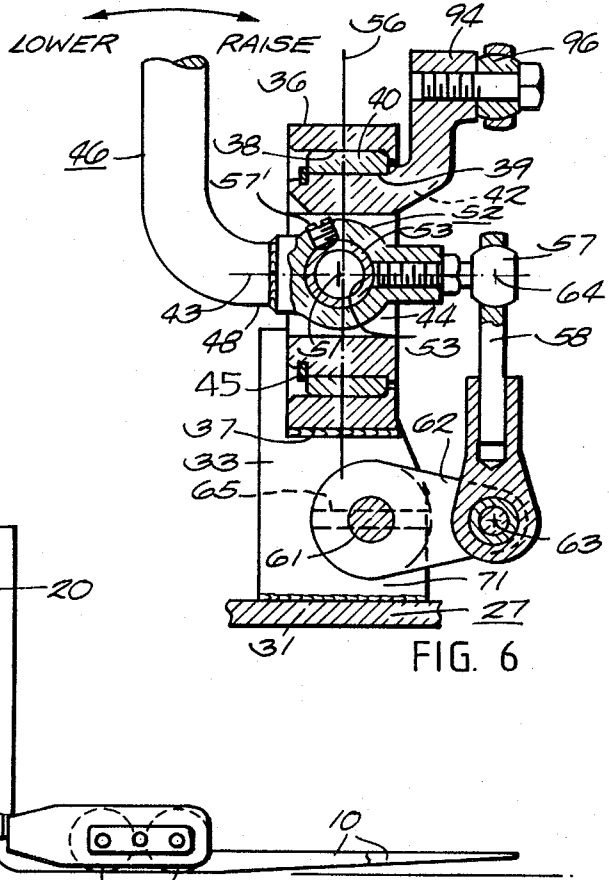
FIG. 6 is a view taken along the line VI—VI in FIG. 5.
Figure 3:
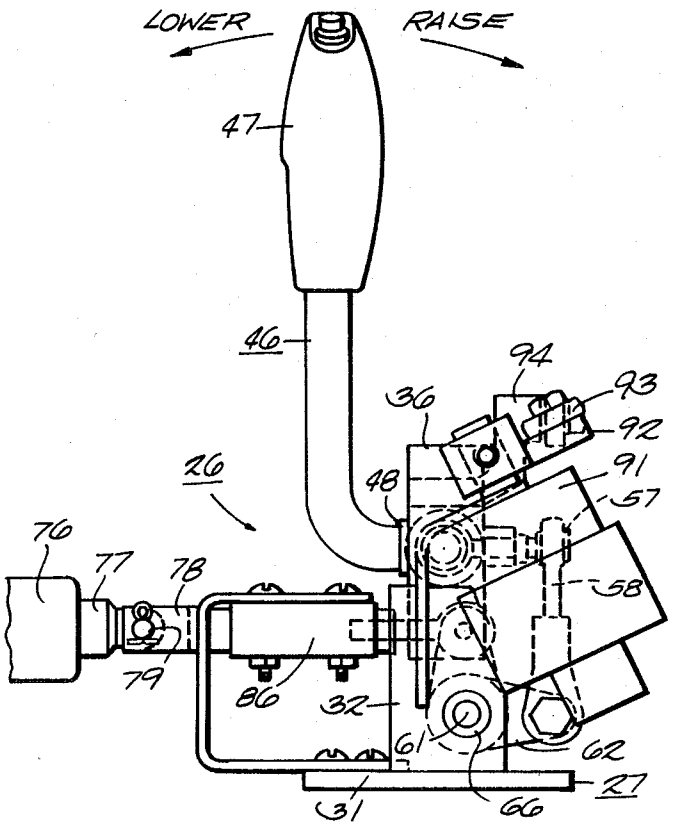
FIG. 3 is an enlarged rear view of the single lever control device utilized in the lift truck illustrated in FIGS. 1 and 2.
Figure 7:
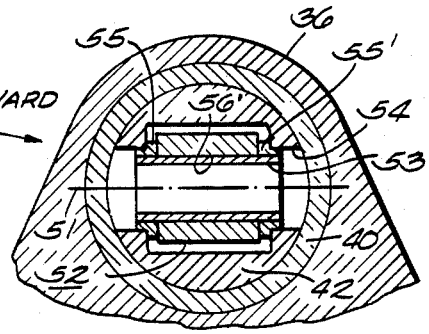
FIG. 7 is a view taken aong the line VII—VII in FIG. 4.

When the operator wishes to raise the load carriage 20, he moves the control lever 46 to the right, as viewed in FIGS. 2, 3 and 6, thereby causing the rock shaft 61 to rotate clockwise which in turn causes the link 78 and the valve spool 77 to be moved to the right from its detented neutral position to its raise position. Such shifting movement of the link 78 causes the switch 86 to be actuated which in turn causes a fluid pump to deliver pressure fluid to the lift jack, not shown, via the valve spool 77 which is in its raise position. Lowering of the carriage 20 is achieved by pivoting the lever 46 counterclockwise, as viewed in FIGS. 2, 3 and 6, to cause the valve spool 77 to shift to the left from its detented neutral position, in which illustrated, to its lower position which permits exhaust of fluid from the single acting lift jack. Since pressurized fluid is not required for a carriage lowering operation, the switch is not actuated and the hydraulic pump is not operated.

Figure 5:
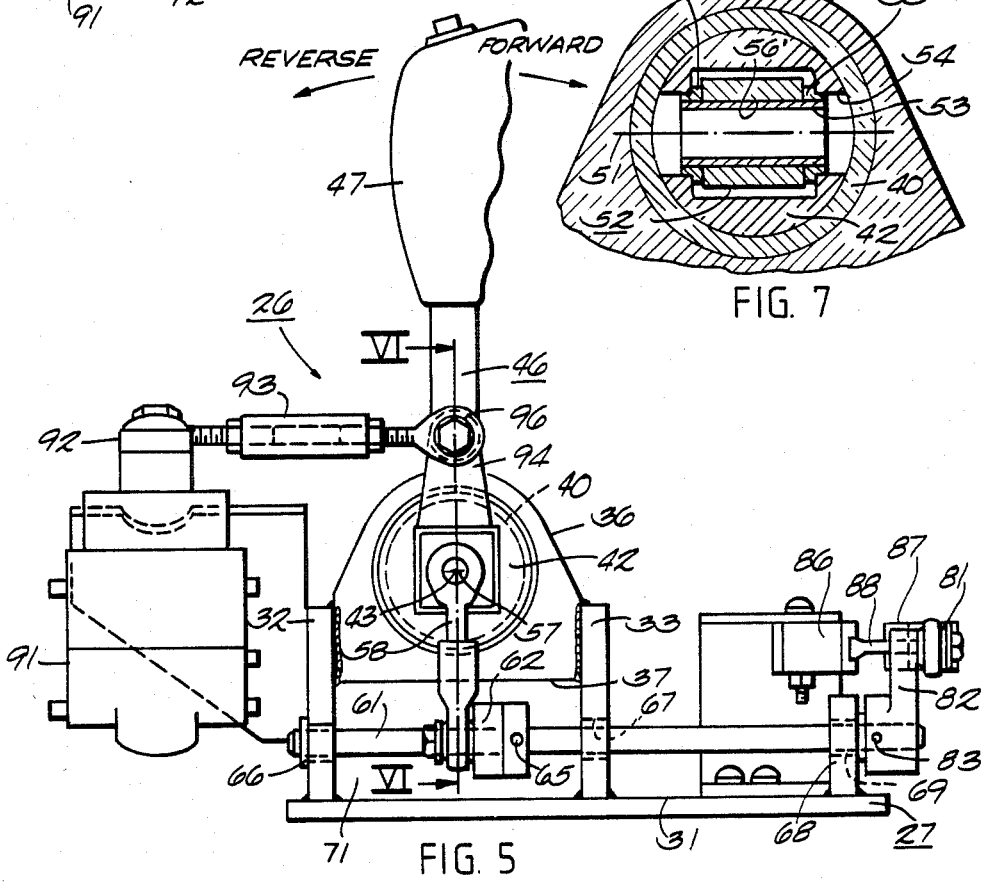
FIG. 5 is a side view of the control device illustrated in FIGS. 3 and 4.

When the lift truck operator desires to move the truck forward the control handle is moved in a forward or clockwise direction as viewed in FIGS. 1 and 5. Such movement causes the electric drive motor control lever 92 to move counterclockwise as viewed in FIG. 4. Initial forward movement of the lever 92 from its neutral position, to which it is biased, establishes the forward direction of travel and further forward movement progressively increases the speed of travel in the forward direction. Rearward movement of the manual control lever 46 from its illustrated neutral position causes progressively increased speed of travel in a reverse direction.

The mounting of the manual control lever 46 on a single, relatively narrow bearing member 42 for relative rotation only about bearing axis 51 and the pivoting of the bearing member 42 to the support wall 36 for relative rotation only about axis 43 with axes 51 and 43 intersecting adjacent the central vertical plane 56 of the wall 36 provides a very compact single lever control device for operating two lift truck controls.

The embodiments of the invention in which an exclusive property or privilege is claimed are defined as follows:

1. A single lever control device for operating two separate controls comprising:

a single upstanding support wall of predetermined thickness having laterally opposite sides and a radially inward facing cylindrical bearing surface extending axially between said sides defining a single cylindrical opening through said support wall generally transverse to said opposite sides, a control member having a main part disposed within said single cylindrical opening, said main part having a radially outward facing cylindrical bearing surface in cooperative pivotal bearing engagement exclusively with said inward facing cylindrical bearing surface for rotation about a bearing axis transverse to said wall, said main part of said control member having radially inward facing surfaces defining a central opening through which said bearing axis passes, a control lever including an upstanding hand grip portion at one side of said wall and a horizontal leg extending from the lower end of said hand grip portion and through and beyond said central opening, pivot means within said central opening pivotally connecting an intermediate portion of said leg to said main part of said control member for pivotal movement about a pivot axis disposed transverse to said bearing axis and between said opposite sides of said single support wall, said leg and control member pivoting relative to one another only about said pivot axis, an arm on said main part of said control member extending from the side of said main part at said other side of said support wall, a first control pivotally connected to said arm at a first point spaced from said bearing axis, said first control being actuated when said lever is pivoted about said bearing axis and a second control pivotally connected to said leg of said control lever at a second point at said other side of said support wall and spaced from said first point, said second control being actuated when said lever is pivoted about said pivot axis.

2. The control device of claim 1 wherein said second control includes a generally horizontal rock shaft parallel to the plane of said wall and disposed below said control member, an arm secured to and projecting radially from said rock shaft at one lateral side of said wall and a vertically extending link having its opposite ends pivotally connected, respectively, with said leg of said lever and said arm.

3. The control device of claim 2 wherein said hand grip portion is disposed at one lateral side of said support wall, said leg includes a free end extending beyond the opposite side of said support wall and said link is connected to said free end.

4. The control device of claim 1 wherein said main part of said control member presents aligned bores on said pivot axis which extend radially outwardly from said central opening and terminate at said outward facing cylindrical surface, wherein said pivot means includes a cylindrical pivot pin secured to and with portions extending in opposite directions from said intermediate portion of said leg and a pair of stepped diameter bushings on said portions, respectively, in bearing engagement with said bores and with radially oppositely facing portions of said radially inward facing surfaces defining said central opening.

* * * * *